United States Patent [19]

Martin

[11] 4,140,313

[45] Feb. 20, 1979

[54] NET REBOUND WALL ADAPTER FOR TENNIS ENCLOSURE

[76] Inventor: Arthur L. Martin, 2876 N. Rodgers Ave., Ellicott City, Md. 21043

[21] Appl. No.: 842,310

[22] Filed: Oct. 14, 1977

[51] Int. Cl.[2] ..... A63B 69/40

[52] U.S. Cl. ..... 273/29 A

[58] Field of Search ..... 273/26 A, 181 F, 55 B, 273/127 R, 102 S, 102 R, 105 R, 103, 176 B, 182 R, 181 R, 181 G, 181 J, 29 A, 95 R, 1.5 A, 95; 74/242.1 R, 242.8, 242.1 AT, 242.11 P, 242.12, 242.9, 242.15 R

[56] References Cited

U.S. PATENT DOCUMENTS

| | | | |
|---|---|---|---|
| 920,907 | 5/1909 | Bolton | 273/181 F |
| 2,005,241 | 6/1935 | Robinson | 273/29 A |
| 2,067,071 | 1/1937 | Braune | 273/29 A |
| 2,823,034 | 2/1958 | Bingham | 273/181 F |
| 2,944,816 | 7/1960 | Dixon | 273/181 F |
| 2,992,002 | 7/1961 | Bingham, Jr. | 273/95 |
| 3,180,643 | 4/1965 | Kallai | 273/29 A |
| 3,228,033 | 6/1967 | Hendry | 273/127 R |
| 3,825,259 | 7/1974 | Burchett | 273/29 A |
| 3,918,711 | 11/1975 | Zak | 273/181 F |
| 4,082,271 | 4/1978 | Martin | 273/29 A |

*Primary Examiner*—Richard C. Pinkham
*Assistant Examiner*—T. Brown
*Attorney, Agent, or Firm*—John F. McClellan, Sr.

[57] ABSTRACT

A tennis ball net rebound structure having pivotal, extensible and retractable members. The members are spaced apart horizontally and attachable at one of their ends to a fencing support structure and having their other end attached to an elongated rod. The net is attached at its upper and lower ends to the fencing support structure with its upper end spaced from the fencing, the net further being positioned between the pivotal, extensible and retractable members such that the rod engages the net along the width thereof whereby the net is angularly adjusted and tensioned when the members are pivoted.

12 Claims, 6 Drawing Figures

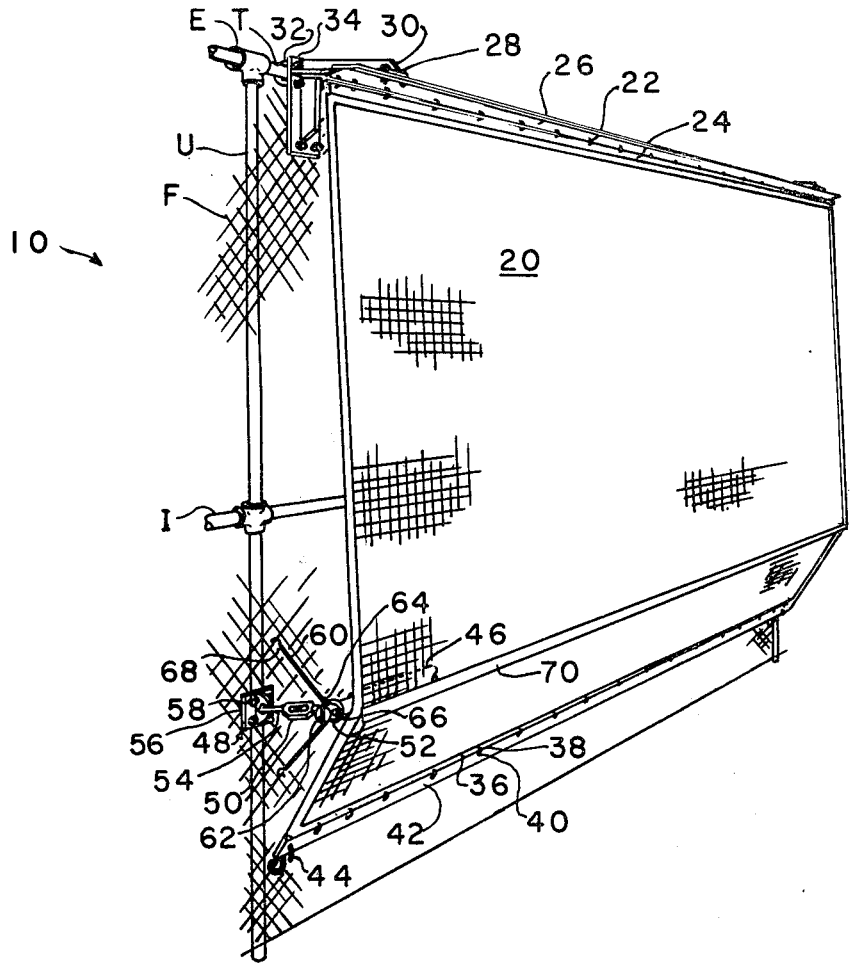
FIG. 1
FIG. 2
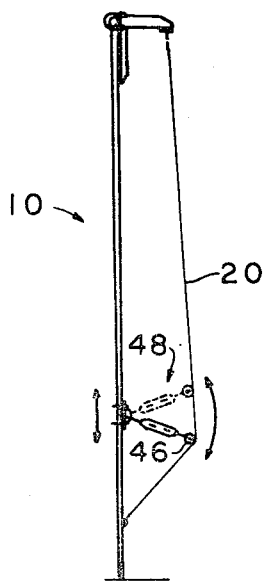
FIG. 3
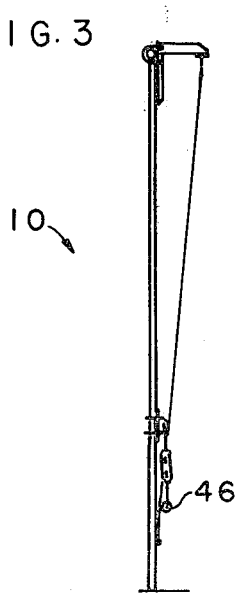

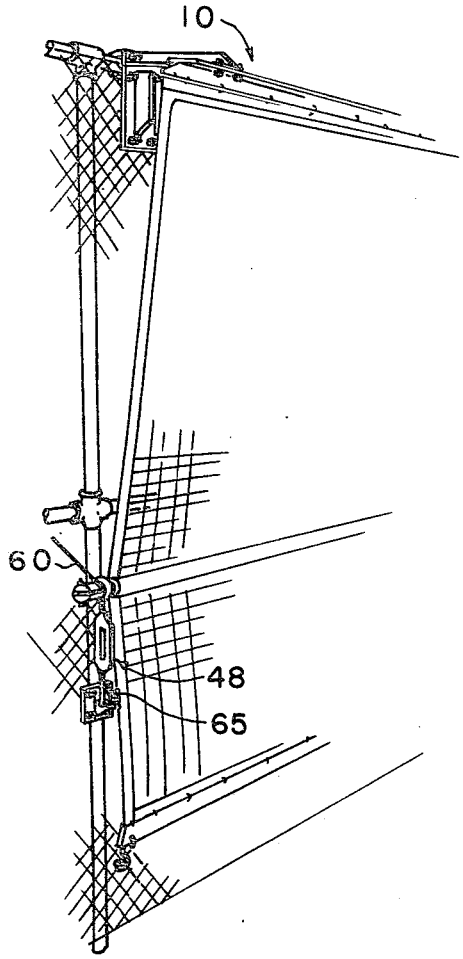
FIG. 4
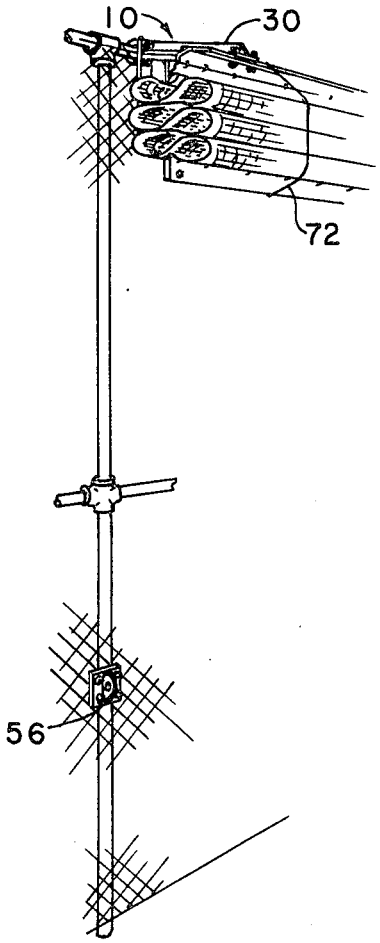
FIG. 5
FIG. 6
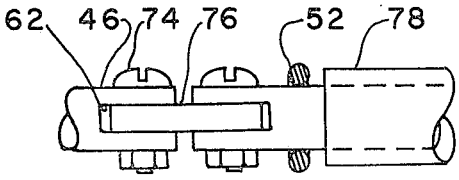

NET REBOUND WALL ADAPTER FOR TENNIS ENCLOSURE

Cross reference for priority purposes is made to my co-pending U.S. patent application Ser. No. 681,762, filed Apr. 29, 1976, (U.S. Pat. No. 4,082,271) for TENNIS PRACTICE NET. This invention relates generally to sports apparatus and particularly to a novel rebounder for tennis practice.

In the prior art numerous rebounder disclosures appear including those in the following U.S. Pat. Nos.:

2,005,241 to C. I. Robinson, June 18, 1935, discloses rebound apparatus against a wall or other backstop (FIG. 4);

2,067,071 to M. K. Browne, Jan. 5, 1937, discloses a net cantilevered from a backstop;

2,823,034 to H. Bingham, Jr., Feb. 11, 1958, discloses inclined rebound netting supported by a wall of a recreation enclosure of fencing material, and means for adjusting tension of the rebound netting;

2,992,002 to H. Bingham, Jr., July 11, 1961, discloses a rebound net supported on a wall of a recreation enclosure, with means to tension the rebound netting;

3,697,068 to J. P. McDougall, Oct. 10, 1972, discloses netting supported by a wall; and 3,989,245 to P. Augustine et al., Nov. 2, 1976, discloses a target wall in and supported by an enclosure.

However, it is believed that the unique structure and advantages of the present invention including those set out in the following objects of the invention have not previously been known or fairly suggested by the prior art.

A principal object of this invention is to provide an adapter which will convert any chain link type tennis court upright enclosure fencing to a net rebound wall safe to leave in place and easily stored in place if desired during normal play and requiring only the existing enclosure fencing for support.

Further objects are to provide a tennis practice rebounder as described which is instantly adjustable in angle setting upward or downward, and in tension; which has adjustable-height net-top indication, which can deflect downwardly out of play balls lower than net-top height and rebound naturally those higher than net top height to encourage careful stroking, which has multi-width installation capability, which transfers all stresses to the net margins, which provides gross tension adjustment using existing fencing, which provides several modes of use and of storage, which is adaptable to almost every type tennis court chain link enclosure fencing, which is economical to purchase and install and easy to use and adjust for optimum return, and which is durable and attractive in appearance.

In brief summary of the invention given for cursive description only and not as limitation the invention includes tennis practice rebounder apparatus providing for suspension from existing customary tennis court enclosure fencing and for bias tensioning and angle setting at an intermediate area.

The above and other objects and advantages will become more readily apparent on examination of the following description, including the drawings in which like reference numerals refer to like parts:

FIG. 1 is a perspective view of the invention installed on tennis enclosure fencing;

FIG. 2 is a side-elevational diagram showing positional adjustments according to the invention;

FIG. 3 is a view similar to the previous Figure of a further mode of positional adjustment;

FIG. 4 is a perspective detail of one mode of storage of the invention;

FIG. 5 is a perspective detail of another mode of storage of the invention out of the way; and FIG. 6 is a multi-unit coupling detail.

FIG. 1 shows the invention 10 ready for rebounder practice in one particular adjustment, mounted on a tennis enclosure E, typically of chain-link fencing F and supported by tubular uprights U connected by top rail T and intermediate rail I.

The invention includes a rectangular-shape, reinforced-margin rebounder net 20 suspended in generally parallel-spaced relation to the fencing by rings 22 securing the upper margin 24 to a "T"-section rail 26 held by bolts 28 through the top flange to the flange of an inverted-"T"-section inverted "L" shaped suspension bracket 30 near each end of the "T"-section rail, each of the arms being cantilevered from the top rail T of the fencing by "U" bolts 32 passing through respective butt plates 34 welded on the end of the horizontal leg of the suspension bracket, and at the downward ends of the butt plates fastened by "U" bolts to the fencing itself for additional rigidity.

The lower margin 36 of the net secures by ties 38 which may be attached directly to the fencing, but which preferably attach at respective holes 40 in a bar or bottom rail 42 extending from upright to upright and hooking to the fencing by "S" hooks 44.

Intermediate the height of the net at a position about equal to regulation tennis-net height is means for biasing the net in or out with respect to the fencing, in the form of a rod 46 extending horizontally along the net somewhat more than the width of the net and at each protruding end pivotally secured to a fencing upright by a respective pivotally positionable adjustable cam assembly 48. One or more additional pivotal cam assemblies may also be installed along the rod if desired.

Each pivotal cam assembly includes a length extending and shortening turnbuckle 50 with one end a rigid screw-eye 52 encircling the rod and the other end a rigid screw "L" 54 having a leg acting as a pivot passing through a journal bracket 56 in which it secures by a clip described later. The journal bracket attaches by "U" bolts 58 to an upright, along which it is vertically adjustable.

The pivotal cam assemblies adjustably hold in pivotal angle by means of a length of line 60 at each protruding end passing through a slot 62 in the rod and positioned by a respective knot 64 in the line on either side of the slot and bolt or cotter key 66 or other suitable keep outboard the line. "S" hooks 68 on the line ends engage the fencing where desired. A net-height simulated net-tape 70 may advantageously be fastened across the front of the rod; balls driven above the rod will rebound for replay and those driven below will deflect downwardly.

In a customary installation net width may be 10 to 12 feet (3 to 3.7m), distance between supporst may be 6 to 8 feet (1.8 to 2.4m), spacing out from the wire fencing at the top may be 8 inches (20cm) and the pivotal cam can adjust from zero to substantially beyond the overhang, for example 12 to 18 inches from the fencing, at least half this by turnbuckle adjustment; hanging length should reach just short of the fencing bottom.

FIG. 2 shows (arrows) that the pivotal cam assembly 48 turnbuckle-adjustment and the pivotal adjustment in conjunction with the up-and-down translational adjustment of the journal plates provide for setting up the net to suit any player and for making relatively large changes in angle and in tension, using the turnbuckles, practically instantly. Effective net-height changes can be made as shown with accomodating adjustments preserving angle and tension.

FIG. 3 diagrams the invention 10 in a further arrangement for practice rebounding, with the rod 46 outside the net and pressing inward, permitting an entire new range of sharper-angle downward settings, to suit particular requirements. The rod ends may extend past the net to the pivotal cam connections to permit this. In both this and the previous mode and in the stowage modes to be described, the "S" hooks at the bottom are easily unhooked and rehooked higher or lower as required, the fencing thus serving as gross tension-adjustment means.

FIG. 4 shows ease of stowage, the pivotal cam assemblies 48 being simply pivoted up (or down) and the lines 60 resecured and holding the ends of the nets to the rod. The quick-detach, snap-out loop-shaped pin 65 retaining the "L" screw in the journal is visible in this view.

FIG. 5 shows an alternative mode of stowage, as for tournaments, in which the "L" screw ends of the turnbuckles unsnap from the journal plates when the respective pins or keys are pulled and the entire unit can be furled near the top of the enclosure, as by auxiliary ties 72. Alternatively in this mode, it is evident that the net and lower parts can be stowed on top the suspension arms 30, or that the "S" hooks can be used to hook the bottom rail high on the fence out of the way with only the soft net drooping below. In any event, the only parts remaining below will be the journal brackets 56 which are advantageously small, tumbled to remove sharp edges, and are cushioned by a thick layer of soft rubber or vinyl in the preferred embodiment.

FIG. 6 indicates a further advantage of the end slots 62 of the rods 46. Together with suitable link plates 76 inserted in them and secured by cotter keys or by bolts 74 they provide union for rod end-to ending in multiple-net installations. In such multiple width assemblies adjacent margins of successive nets can be tied or clipped together, forming a continuous rebounder of greater width.

A further important feature of the invention is apparent in the tubular covering or sleeve 78 which may be of aluminum or plastic and sized to rotate on the rod permitting the net to slip easily upward or downward under strain of ball impact, always transferring stresses to the margins and preventing intermediate tearing.

From the foregoing description it will be appreciated also that by means of the pivot arm assemblies the net can be deliberately twisted in adjustment if desired, or as easily adjusted to remove twist, and that the invention can be installed on either the inside or the outside of the type-enclosure described, without modification.

Although somewhat exaggerated in the Figures, the net at the top stands away from the fencing about one foot (30cm).

Materials and dimensions for the preferred embodiment are as follows; these are given by way of example only, and are for use with the customary ten foot to twelve foot center-spacing uprights:

net, "Nylon" or polypropylene with taped or otherwise enforced eyelet-equipped margins; suspension bracket arms and rail, 6061 T6 aluminum, 3 × 3 × ⅛ inch (75 × 75 × 3mm) in section (or steel or fibreglass equivalent); bar 2 × ¼ inch (50 × 6mm) section, aluminum as above; rod 1" diameter wood or plastic (or metal tubing; ties and rings, commercially available plastic or plastic covered; turnbuckles, 8 to 12 inch (20 to 25cm) body-length aluminum as above.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. In tennis practice structure for support by upright fencing, including a net, means hanging said net at its upper end, on and in front of a said support fencing, and means for securing the bottom of the net to a said support fencing, the improvement comprising: means at an intermediate portion of said net for adjustably setting the angle of said net relative to a said support fencing, and said means for adjustably setting the angle includes means for adjustably tensioning the net.

2. In tennis practice structure as recited in claim 1, wherein said means for adjustably setting the angle and means for tensioning said net includes a pivotal cam assembly having at a first end thereof, means for affixing said first end to a said support fencing for pivotal attachment and at a second end thereof means for adjustably positioning said second end relative to said net.

3. In tennis practice structure as recited in claim 2, wherein said pivotal cam assembly has means for extending and shortening the length thereof between said first and second ends thereof.

4. In tennis practice structure as recited in claim 3, wherein said means for adjustably positioning includes a rod across said net, said pivotal cam assembly having at said second end means attaching said cam assembly to said rod and means for holding said rod relative to said net.

5. In tennis practice structure as recited in claim 4, wherein said means for extending and shortening the length of said pivotal cam assembly includes turnbuckle structure.

6. In tennis practice structure as recited in claim 4, wherein said means for holding said rod includes at least one line having a first end affixed to said rod and a hook on a second end of the line for engaging a said support fencing.

7. In tennis practice structure as recited in claim 6, wherein said rod is longer than the width of said net and is held at each end thereof by said cam assembly and rod attaching means in position for pressing said net towards a said support fencing.

8. In tennis practice structure as recited in claim 7, wherein said rod has a sleeve thereon, the sleeve rotatable on and relative to said rod upon movement of said net therepast.

9. In tennis practice structure as recited in claim 8, wherein said means for hanging said net includes plural brackets, each bracket being of inverted "L" shape and being affixed to a said fencing; and a top rail pendant from said brackets and supporting said net.

10. In tennis practice structure as recited in claim 9, wherein said means for securing said bottom of the net includes a bottom rail therealong, and means for adjustably fastening said bottom rail to a said support fencing.

11. In tennis practice structure as recited in claim 10 wherein, a tape is affixed on said net adjacent said rod for defining a practice target area.

12. In tennis practice structure as recited in claim 11 wherein, said pivotal cam assembly means includes a bracket having means for adjustably securance to said fencing, quick detachable connection at said pivotal attachment, and said bracket being covered by a resilient cushioning covering.

* * * * *